US006481651B1

(12) United States Patent
Pinoncely et al.

(10) Patent No.: US 6,481,651 B1
(45) Date of Patent: Nov. 19, 2002

(54) METHOD AND PLANT FOR DISINTEGRATING CRUDE MATERIAL IN LUMPS INTO A GRANULAR MATERIAL ACCORDING TO PARTICLE SIZE DISTRIBUTION

(75) Inventors: André Pinoncely, Brignais (FR); Jean-Françis Pinchon, Villenrbanne (FR)

(73) Assignee: FCB Societe Anonyme, Montreuil (FR)

( * ) Notice: Subject to any disclaimer, the term of this patent is extended or adjusted under 35 U.S.C. 154(b) by 0 days.

(21) Appl. No.: 09/367,113

(22) PCT Filed: Feb. 13, 1998

(86) PCT No.: PCT/FR98/00280

§ 371 (c)(1),
(2), (4) Date: Aug. 10, 1999

(87) PCT Pub. No.: WO98/36841

PCT Pub. Date: Aug. 27, 1998

(30) Foreign Application Priority Data

Feb. 19, 1997 (FR) ..... 97 02178

(51) Int. Cl.[7] ..... B02C 15/00
(52) U.S. Cl. ..... 241/24.3; 241/81
(58) Field of Search ..... 241/81, 24.3

(56) References Cited

U.S. PATENT DOCUMENTS

| | | | | |
|---|---|---|---|---|
| 3,003,708 A | * | 10/1961 | Leonard | 241/81 |
| RE26,727 E | * | 12/1969 | Clark | 241/101 |
| 3,514,045 A | | 5/1970 | Sellars | |
| 3,622,083 A | | 11/1971 | Greenewald | |
| 3,622,087 A | * | 11/1971 | Oltmann | 241/62 |
| 3,622,089 A | | 11/1971 | Quinn | |
| 3,753,746 A | * | 8/1973 | Koerner | 261/122.1 |
| 4,116,390 A | | 9/1978 | Wengeler | |
| 4,418,892 A | * | 12/1983 | Howell | 266/137 |
| 4,824,031 A | * | 4/1989 | Wiley | 241/39 |
| 4,923,124 A | * | 5/1990 | Wiley | 241/18 |
| 5,375,779 A | | 12/1994 | Ephraim | |
| 5,379,948 A | | 1/1995 | Teppo | |
| 5,648,306 A | * | 7/1997 | Hahn et al. | 119/172 |
| 5,683,043 A | * | 11/1997 | Schneider | 241/65 |
| 6,042,032 A | * | 3/2000 | Pinoncely | 241/24.1 |

FOREIGN PATENT DOCUMENTS

| | | |
|---|---|---|
| EP | 0 514 953 | 11/1992 |
| FR | 2 236 560 | 2/1975 |

* cited by examiner

*Primary Examiner*—William Hong
(74) *Attorney, Agent, or Firm*—Harrison & Egbert

(57) ABSTRACT

A process for the grain size reduction of a raw material in piece form, wherein:

all or part of the material in piece form is subjected to a grinding operation, capable of enabling to be obtained at its output a material in grain form having a requisite grain size distribution, starting out from any given grain size of the material in piece form;

downstream, the material in grain form obtained is directed exclusively towards a common container, whatever the size of the grains, so as to obtain, in a single run, in the said container, a mixture of material in grain form having the grain size distribution, for use as such.

5 Claims, 4 Drawing Sheets

METHOD AND PLANT FOR DISINTEGRATING CRUDE MATERIAL IN LUMPS INTO A GRANULAR MATERIAL ACCORDING TO PARTICLE SIZE DISTRIBUTION

TECHNICAL FIELD

The present invention relates to a process and to a plant, in particular operating continuously, for comminuting a raw material in the form of pieces and obtaining a material in the form of grains having a requisite grain size distribution, as well as to an application of the mixture of material in grain form obtained by implementing such a process.

BACKGROUND ART

In the field of fragmentation, one often has occasion to produce, from a materiel in piece form, grains the differences in size whereof comply with a predetermined grain size distribution or range in order, in particular, to permit subsequent a utilization of this material using various means for packing by vibration, compacting or pressing, to minimize the addition of binder that might be required at the time of said utilization and/or to optimize the physical characteristics of the finished part after forming, according to criteria which are also predetermined.

One characteristic that is generally of prime importance in defining this grain size range is the ability of the fine grains to fill in as precisely as possible the intergranular voids between the larger-sized grains, a characteristic which contributes tots optimization of the compactness or density of the finished part, to a reduction in the consumption of any binder required to fill in the voids, as well as to better performance in terms of mechanical strength and/or electrical or thermal conductivity.

Another characteristic that is often sought after in the coarse fractions in this grain size range is optimum compressive strength, so that they do not deteriorate upon subsequent use, and enhance the mechanical properties of the finished part after forming.

At the present time, there is no control over the characteristics of the raw materials used, or over the grain size distribution of the grains directly resulting from fragmentation operations.

To obtain dimensional distribution of the grains in compliance with the requisite grain size range, it thus appears essential to break down the grain size preparation process into two steps.

The first step consists in dividing the material into several grain size fractions by means of grading or classifying apparatus, in reducing any excess amounts of certain fractions by means of breaking or grinding apparatus, in recycling the fragmented products through the classifying apparatus, and in storing the different fractions thus produced in buffer hoppers or silos according to grain size.

The second step consists in reconstituting a mixture of the different grain size fractions produced in the first step, in order to conform to the requisite grain size range, because of controlled extraction of the materials beneath each of the silos using volumetric /and or weight based proportioning systems.

Although plants are known which make use of only one fragmenting apparatus for simultaneously producing the different fractions, these operations as a whole and, more especially, classifying and mixing, necessitate numerous, cumbersome items of equipment, particularly when one wishes to minimize the non-reusable excess quantities of materials. In addition, they operate in a closed circuit and involve recycling of materials. They are thus complex and costly.

The object of the invention is to provide a process and a plant for grain size reduction of a raw material in piece form to obtain a material in grain form that overcome the aforementioned drawbacks and permit the direct production, particularly continuous production, of a requisite grain size distribution without recycling, and without either classifying or re-mixing of all or any of the fragmented products.

Another object of the present invention is to provide a process and a plant for grain size reduction of a raw material in piece form that permit direct use of the material in grain form obtained without having to modify its grain size distribution once again according to the desired application.

A further object of the present invention is to provide an application of the mixture of material in grain form permitting the manufacture of objects having advantageous physical properties.

Further objects and advantages of the present invention will emerge in the course of description that follows, which is provided only by way of illustration and is not intended to limit the invention.

SUMMARY OF THE INVENTION

The present invention relates, first of all, to a process for the grain size reduction of a raw material in piece form to obtain a material in grain form, wherein:

- all or part of the material in piece form is subjected to a grinding operation, capable of enabling to be obtained at its output a material in grain form having a requisite grain size distribution, starting out from any given grain size of the material in piece form;
- downstream, the material in grain form is directed exclusively towards a common container, whatever the size of the grains, so as to obtain, in a single run, in the container, a mixture of material in grain form having the grain size distribution, for use as such.

The process according to the invention uses a raw starting material the pieces of which have, sizes which are smaller than or equal to 200 mm.

Advantageously, the pieces are subjected to grinding by layer crushing. It has been found, in fact, that, by choosing such a technique, the parameters of the grinding operation can be selected such that the product in grain form obtained conforms to the requisite grain size range, starting out from pieces of any size, and, what is more, in an open circuit.

The term grinding by layer crushing refers to those grinding processes in which a multigranular layer of material for crushing is compressed between two surfaces, sufficient pressure being applied to cause fragmentation of the grains, which are comminuted to form smaller grains.

During the process of grinding by layer crushing, the compressive force exerted is transmitted within the layer of material from grain to grain via inter-grain contact zones.

At the start of this process, owing to the coarse grain size of the material, the intergranular voids are generally large, and the inter-grain contact surfaces are limited, which generates considerable pressure and causes the more fragile grains to break up. The smaller-sized grains thus formed are then re-arranged in the vacant intergranular voids, gradually increasing the inter-grain contact surfaces, and, at the same time, reducing local pressure in the contact zones.

As a result, the process contributes to reducing the volume of the intergranular voids, correspondingly increasing the density of the layer of material, until the proliferation of points of contact between grains causes local pressures to drop below the crushing threshold of the grains.

It can thus be seen that the active parts of the grinder for comminuting the grains possibly have little contact with the material. The material in fact grinds itself through the effect of the pressure transmitted between the grains. Abrasive materials can thus be processed, while limiting wear on the parts used.

Because of to this technique, it is also possible to obtain a relatively wide grain size range, for example 0 to 30 mm or more.

Such processes can be used to obtain a grain size distribution that is substantially independent of the initial size of the pieces used. To vary the distribution and/or adapt it to the raw material used, it then suffices to act upon the grinding adjustment parameters such as, the fragmentation force and/or the pressure applied.

The latter will depend, in particular, on the subsequent service pressure of the material, and will be greater than, or at least equal to, this pressure in order to avoid deterioration of the grain at this stage.

Apparatus known for carrying out material bed grinding under pressure are, for example, vertical roller mills, vertical ball mills, horizontal roller mills, roller presses, and cone vibrating grinders.

Use can be made, in particular, of a vibrating vertical cone type grinder, that is to say a grinder in which the cone or the material container is caused to vibrate, the other element, the container or the cone, of the grinder being fixed or mobile. Different examples using some of these grinders are described in more detail below.

In this connection, another object of the present invention is a plant for implementing the above-described process for the grain size reduction of a raw material in piece form including at least means for subjecting all or part of the material in piece form to a grinding operation, capable of enabling to be obtained at its output a requisite grain size distribution of the material in grain form, starting out from any grain size of the material in piece form, as well as means for directing, downstream, the material in grain form exclusively towards a common container, whatever the size of the grains.

According to one advantageous exemplary embodiment, the means for subjecting the material in piece form to a grinding operation are constituted by a fragmenting apparatus carrying out grinding by layer crushing.

As mentioned above, because of the operating principle of such apparatus, it has been found that the material in grain form obtained has grain size distributions that are directly usable, being determined, and the plant according to the invention does not, therefore, require a device for recycling or dividing the fragmented products.

The plant according to the invention thus advantageously includes a single layer crushing grinder. However, other preliminary operations, in particular breaking, could also be contemplated, using other devices provided upstream.

In the event of the requisite grain size range requiring the presence of grains having a size greater than the maximum dimension of the grains produced by fragmenting apparatus used, the plant can be additionally equipped, if necessary, upstream of the apparatus, with a classifying or grading apparatus, which will generally be a screen and/or a grid, permitting the selection of different fractions of the raw material and, in particular, the selection, from its pieces, of one or more coarse fractions missing from the material in grain form. These coarse fractions will then avoid all or part of the grinder, via a bypass.

Advantageously, these coarse fractions will be formed of grains the dimensions of which are greater than or equal to one millimeter.

The present invention thus advantageously concerns an application of the mixture of material in grain form obtained through implementing the above-described process to the manufacture, after compacting, pressing and/or packing by vibration of the mixture, of objects having optimized mechanical properties.

Indeed, particularly, in the case of grinding by layer crushing, as the inter-grain crushing thresholds at the time of fragmentation can differ according to the nature and the cohesion of the grains, there occurs selective fragmentation primarily affecting the fragile grains. Thus, the large grains of the fragmented product primarily originate from the hardest constituents of the raw material.

In addition, as already mentioned, the grain size distribution of the ground product is of satisfactory density, the vacant intergranular voids being filled in at the time of processing.

Because of such processes, and because of this choice, a product already possessing advantageous mechanical characteristics is thus available at the output from the grinder, and prior to any additional processing.

They can be used, for instance, in the manufacture of anodes to produce aluminium by electrolysis. Such anodes are produced, in particular, by coke breaking.

BRIEF DESCRIPTION OF THE DRAWINGS

The present invention will be more readily understood upon studying the following description, accompanied by the annexed drawings, which form an integral part thereof, and in which.

DETAILED DESCRIPTION OF THE INVENTION

Figure 1:
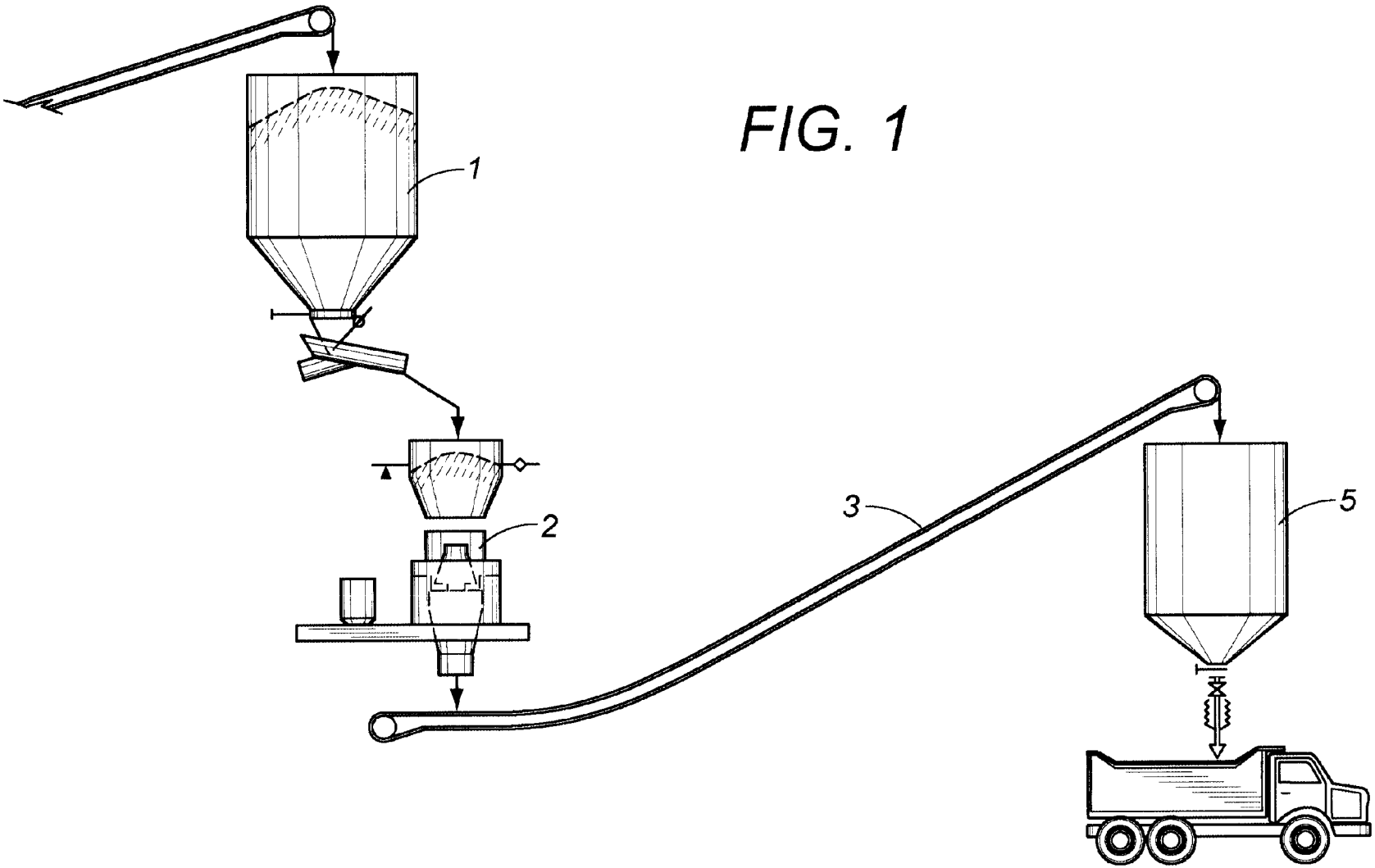
FIG. 1 illustrates a first exemplary embodiment of the process according to the invention.

According to the exemplary embodiment shown in FIG. 1, the plant according to the invention is constituted by a system for supplying the raw material 1, a grinder 2 and a system for transferring material 3 and a system 5 for loading a truck.

Grinder 2 is, for example, a vibrating cone grinder of the type disclosed in documents FR-2.702.970 and FR-2.735.402 in the name of the applicant.

The transferring and truck loading system can also be replaced by any other system such as a device for piling the material on the ground, bagging it or some other device.

Moreover, the grinder 2 can also directly feed a downstream device for mixing the material with a binder, if applicable, and/or, utilizing the mixture.

For certain applications, the plant may also be designed to be mobile, whether towed or self-propelled by mounting it on a chassis for transport by road or rail.

Such a plant can be used, in particular, for producing road building material with grain sizes possibly ranging from 0 to 30 mm.

Figure 2:
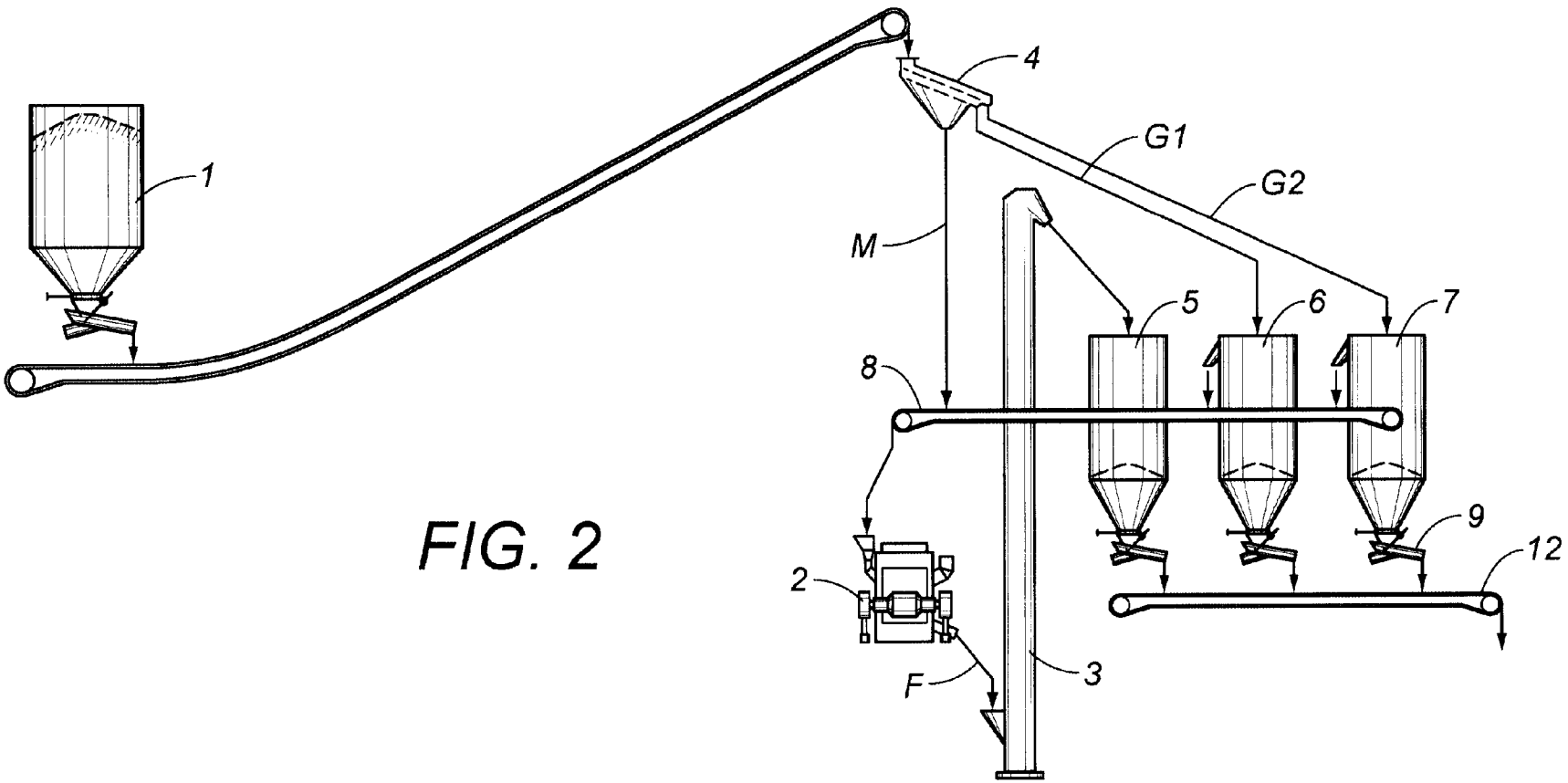
FIG. 2 illustrates a second exemplary embodiment of the process according to the invention.
Figure 3:
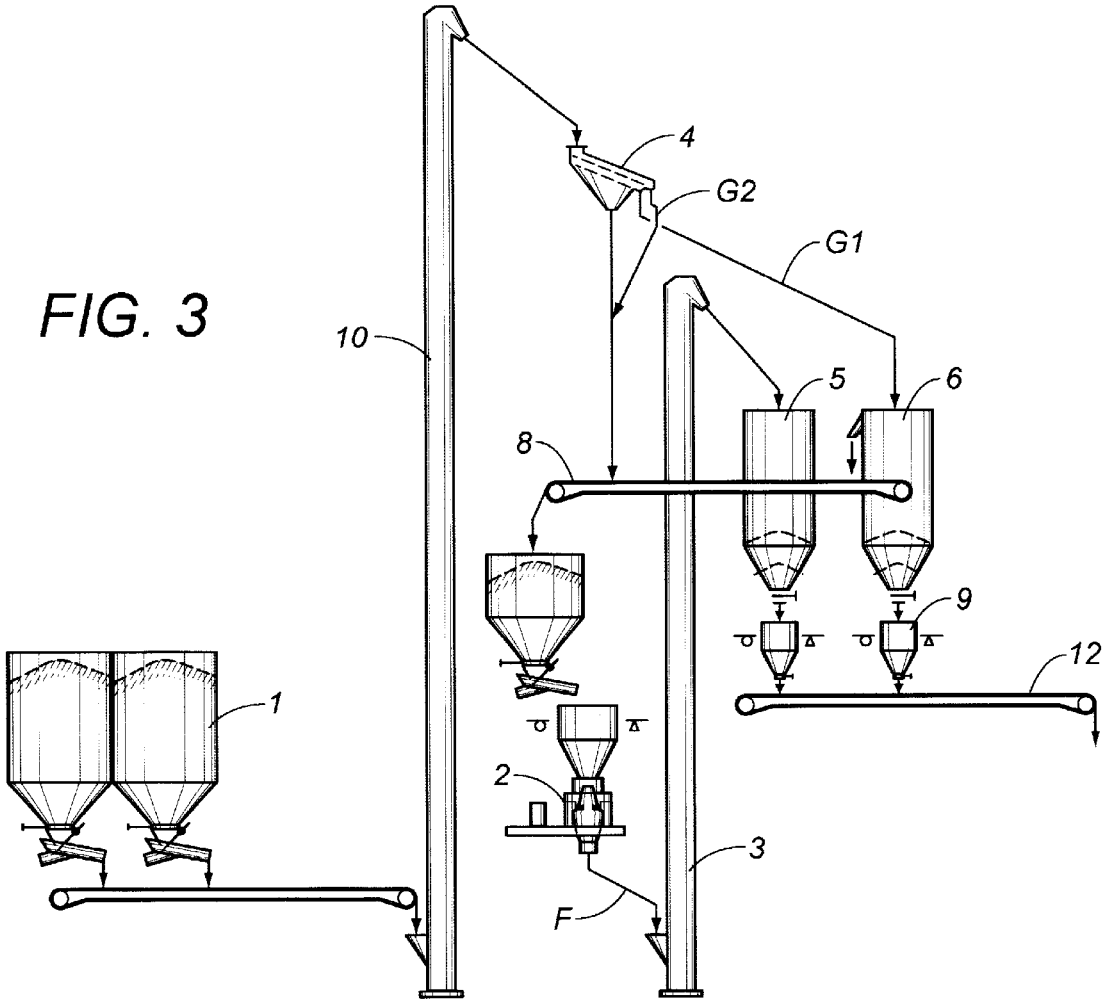
FIG. 3 illustrates a third exemplary embodiment of the process according to the invention.
Figure 4:
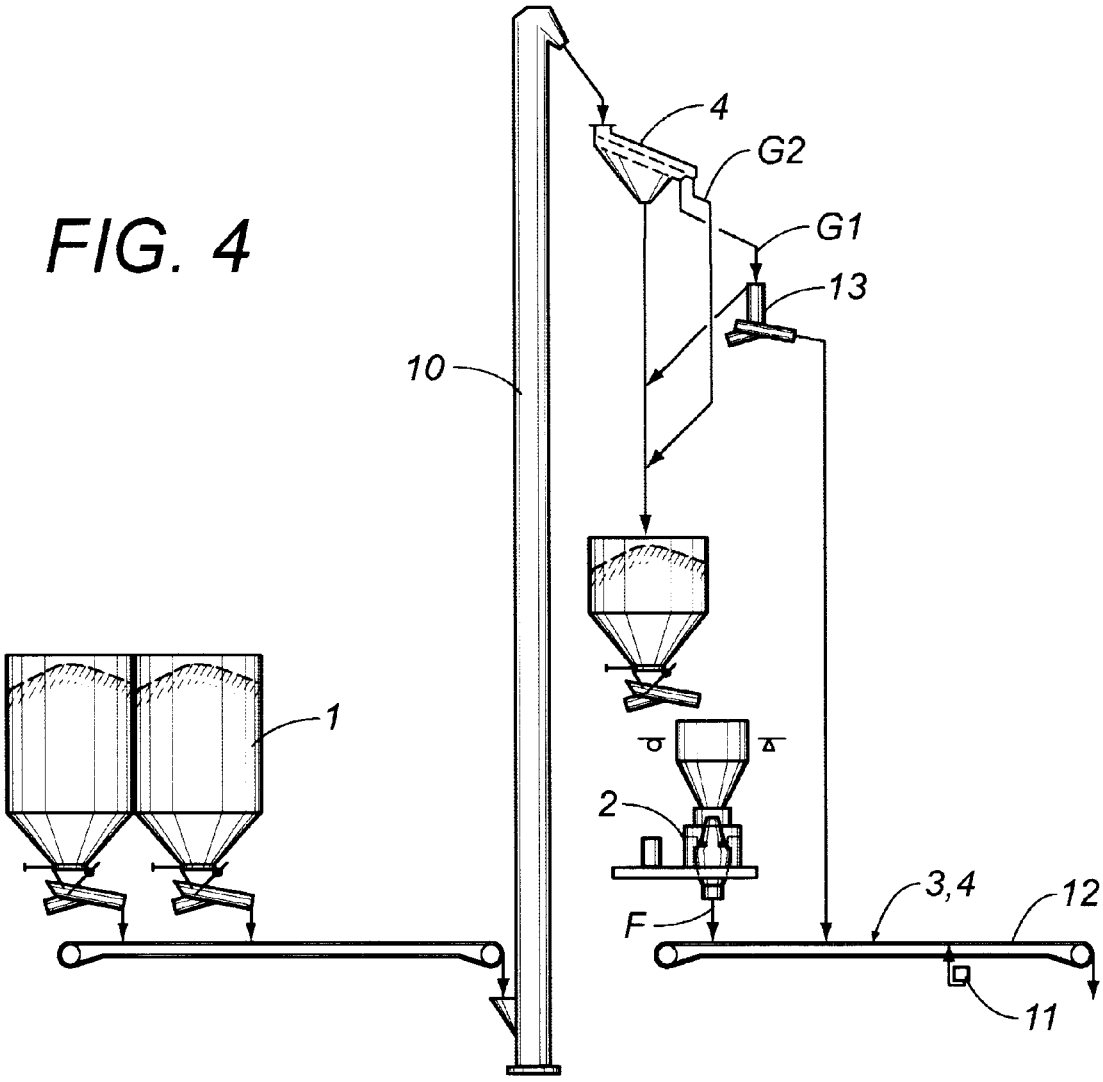
FIG. 4 illustrates a fourth exemplary embodiment of the process according to the invention.

As shown in FIGS. 2 to 4, according to one exemplary embodiment, the raw material is pre-divided into different grain size fractions so that, as already mentioned, some of the coarsest fractions avoid, via a bypass, all or part of the grinding stage and are mixed with the ground material in order to complete the coarse grain content needed to comply with the requisite grain size distribution.

More precisely, the plant diagrammatically represented in FIG. 2 can be contemplated for the manufacture of certain hydraulic concretes.

Such a plant includes, between feed system 1 and grinder 2, for instance, a screen 4 with two meshes or grates which will enable two coarse fractions, G1 and G2, to be extracted from the raw material. These coarse fractions can, for example, be between 5 and 20 mm and between 20 and 40 mm, respectively. They are stored in silos or hoppers 6 and 7.

An overflow device fitted on one or more of these silos or hoppers 6 and 7, followed by a conveyor 8, for example a belt conveyor, can be used to return the excess of these fractions to the input of grinder 2, together with the raw material M passing through the last mesh in the screen.

Grinder 2 is here, for example, a ring roller grinder of the type described in documents FR-90/14.004 and FR-2.679.792.

Fragmented material F, having a size, for instance, of 0 to 10 mm, is then taken by a handling system 3, such as a bucket elevator, for storage in a silo 5.

An extraction and proportioning system 9, constituted here, by way of example, by a vibrating extractor, placed beneath each silo or hopper 5–7, serves to control the flow rate of the fragmented products extracted, as well as that of the corresponding additions of the two coarse fractions needed to complete the fragmented to conform to the requisite grain size range.

According to the variant illustrated in FIG. 3, the mixture of grains obtained after grinding can also be applied, for instance, to preparing the coke for the manufacture of the anodes used in producing aluminium by electrolysis.

Apart from the use of a bucket elevator 10 instead of a belt conveyor to supply the raw material, it differs from the diagram of FIG. 2 only in that all of the coarser fraction, G2, is returned to the input of grinder 2, the corresponding silo being dispensed with, and in that a vibrating cone type grinder, described above with reference to FIG. 1, is used.

In addition, the proportioning system 9 shown beneath silos 5 and 6 is weight based, being of the weight loss type, such as those currently used in conventional plants.

For this application, typical grain sizes for the different streams of material are in the order of 0 to 30 mm in the case of raw coke, 15 to 30 mm in that of fraction G2, 5 to 15 mm in that of fraction G1 and 0 to 15 mm, with a small quantity of over 5 mm, in that of fragmented material F.

FIG. 4 illustrates a simplified alternative to the previous example based on simple volumetric proportioning of fractions F and G1, when the precision of the weight based system is not required.

In this case, intermediate storage in a silo is no longer necessary, and the volume flow rate of fraction Gl is regulated as a proportion of the total flow rate measured on balance 11 of recovery conveyor 12, by acting on the extraction system of overflow type proportioning device 13.

The latter can be, as shown, a variable frequency vibrating extractor type proportioning device.

The operation parameters of grinder 2 are then regulated to ensure on-line control of the total flow rate on balance 11.

The plants described above have, of course, only been given by way of example. Other modes of implementation and/or other applications, within the grasp of a man of the art, could have been contemplated without thereby departing from the scope of the present invention.

What is claimed is:

1. A process for reducing a raw material of piece form comprising:

grinding by material bed grinding under pressure at least a portion of the raw material of piece form so as to produce a material of granular form directly therefrom, said material of granular form having a desired grain size distribution and compactness and compressive strength; and directing said material of granular form exclusively and directly into a common container without changing said desired grain size distribution and compactness and compressive strength, said common container being directly downstream of said step of grinding and without any division of said material of granular form therebetween.

2. The process of claim 1, further comprising:

manufacturing an object from said material of granular form subsequent to said step of directing.

3. The process of claim 1, said object being an anode.

4. A system for reducing grain size of a raw material of piece form comprising:

a container;

a grinding means for grinding the raw material of piece form by material layer crushing so as to obtain a material of granular form having a desired grain size distribution and compactness and compressive strength; and a transfer means directly downstream of said grinding means for directing exclusively said material of granular form into said container without changing said desired grain size distribution and compactness and compressive strength and without further division from said grinding means.

5. The system of claim 4, said grinding means and said transfer means being mounted on a mobile chassis.

* * * * *